United States Patent [19]

Piazza

[11] 4,280,974

[45] Jul. 28, 1981

[54] PROCESS AND APPARATUS FOR MAKING A PLURALITY OF BUILDING MODULES HAVING A FOAM CORE AND A CEMENTITIOUS SHELL

[75] Inventor: Matthew R. Piazza, Nichols, Conn.

[73] Assignee: Hamden Industries, Inc., Hamden, Conn.

[21] Appl. No.: 956,014

[22] Filed: Oct. 30, 1978

Related U.S. Application Data

[63] Continuation-in-part of Ser. No. 810,449, Jun. 27, 1977, Pat. No. 4,133,859.

[51] Int. Cl.[3] ..... B28B 1/08

[52] U.S. Cl. ..... 264/69; 264/157; 264/160; 264/163; 264/256; 264/297; 264/DIG. 57; 425/63; 425/219

[58] Field of Search ..... 264/DIG. 57, 157, 160, 264/163, 256, 297, 69, 70, 71, 72; 425/63, 219

[56] References Cited

U.S. PATENT DOCUMENTS

| | | | |
|---|---|---|---|
| 2,235,001 | 3/1941 | Allen | 264/297 |
| 2,644,217 | 7/1953 | Agar | 264/163 |
| 3,217,375 | 11/1965 | Kinnard | 264/DIG. 17 |
| 3,271,497 | 9/1966 | Elgenstierna | 264/256 |
| 3,295,278 | 1/1967 | Muhm | 264/256 |
| 3,507,738 | 4/1970 | Prusinski | 264/71 |
| 4,133,859 | 1/1979 | Piazza | 264/71 |

*Primary Examiner*—James H. Derrington

*Attorney, Agent, or Firm*—Sprung, Felfe, Horn, Lynch & Kramer

[57] ABSTRACT

A process and apparatus for making a plurality of building modules each having a foam core encased in a shell of fiber reinforced cement. A bottom layer is cast and fiber reinforced in a casting zone having side rails along a base and division members corresponding to the lengths of the modules being formed. End members are placed on top of the division members and foam cores are placed on the bottom layer between end members leaving free space between the core member, the side rails and the end members. Wet cement is applied to fill the free space surrounding each core member and to form a top layer which covers each core member thereby separately encasing each core member. Fiber reinforcement is applied to the top layer and a plurality of cured modules are removed from the casting zone.

19 Claims, 15 Drawing Figures

FIG. 8
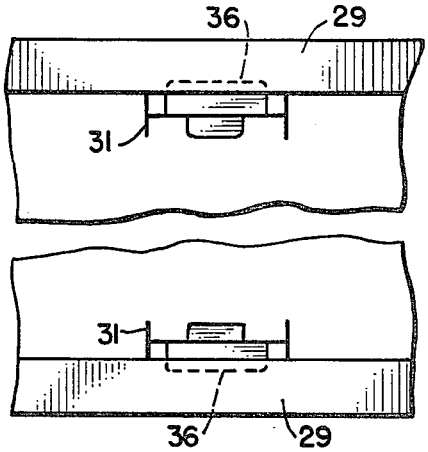
FIG. 9
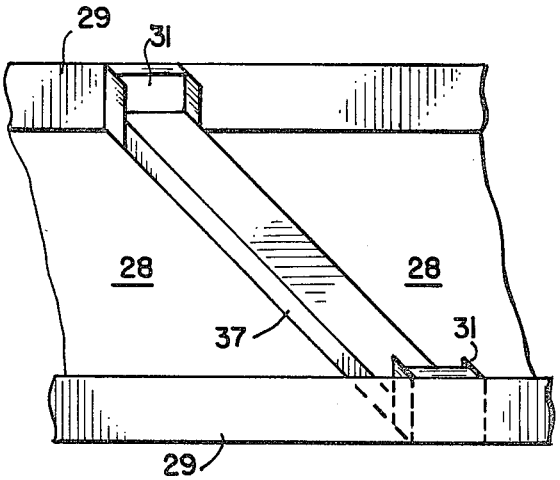
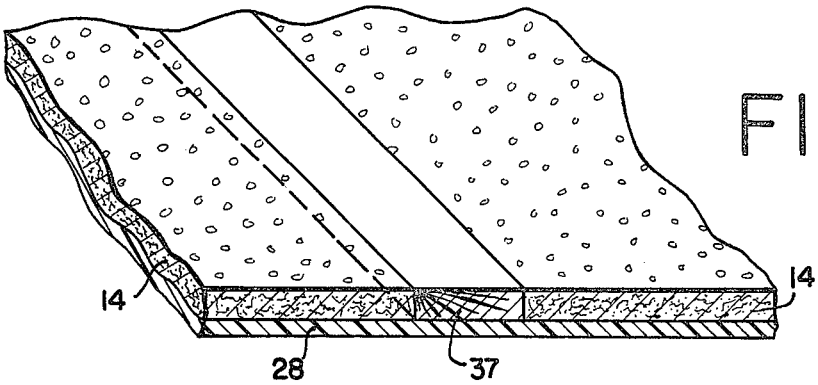
FIG. 10
FIG. 11
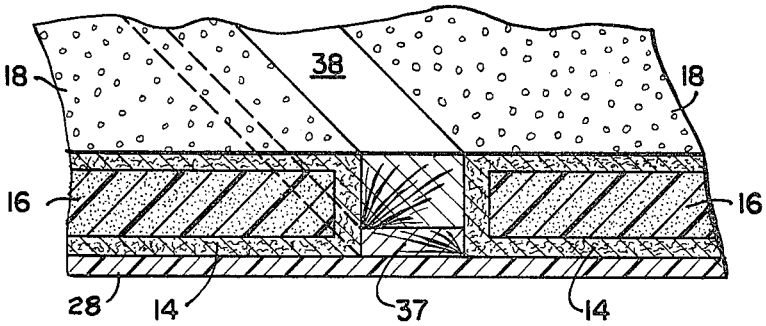

PROCESS AND APPARATUS FOR MAKING A PLURALITY OF BUILDING MODULES HAVING A FOAM CORE AND A CEMENTITIOUS SHELL

The present application is a continuation-in-part application of U.S. application Ser. No. 810,449, filed June 27, 1977, now U.S. Pat. No. 4,133,859 issued Jan. 9, 1979.

BACKGROUND

The present invention relates to a process and an apparatus for making a plurality of building modules, each having insulating foam core encased in a shell of fiber reinforced cementitious material.

Building materials having an insulating foam core encased in a shell of fiber reinforced cementitious material are especially useful in building applications since they have a similar appearance to monolithic cast concrete modules and yet have significant improvements in insulating properties and weight reduction.

Because of increased costs in material and labor, the construction industry has come to use prefabricated building modules for many applications and has sought a simple and economical process and apparatus for making a plurality of these building modules in a continuous manner.

SUMMARY

The present invention provides a process and apparatus for making a plurality of building modules in a simple and economical manner.

This is achieved by the process and apparatus of the present invention which includes:

(a) providing a continuous longitudinal casting zone having continuous side rails along a base having transverse division members thereon positioned so as to correspond to the lengths of the modules being formed;

(b) continuously casting a bottom layer of wet cementitious material between the side rails and over the base and division members along the length of the casting zone and leveling said bottom layer so as to be even with the top of the division members;

(c) adding fiber reinforcement to the bottom layer formed in step (b) by applying fibers in discrete lengths in one or more passes over the casting zone and incorporating the fibers into the bottom layer;

(d) dividing said casting zone into lengths corresponding to the lengths of the modules being formed by inserting end members on top of the division members between the side rails;

(e) placing foam core members on each length of the bottom layer between end members, said foam core members having a peripheral shape smaller than the surface of the bottom lengths so as to leave a free space between the core member, the side rails and the end members, said core member having a height less than the height of the said side rails;

(f) applying wet cementitious material to the entire length of the casting zone so as to fill the free space surrounding each core member and to form a top layer which covers each core member thereby separately encasing each core member;

(g) applying fiber reinforcement to the top layer formed in step (f) by applying fibers in discrete lengths in one or more passes over the casting zone and incorporating the fibers into the top layer; and (h) curing the cementitious material encasing each core and removing a plurality of cured modules from the casting zone.

In a preferred embodiment the wet cementitious material is premixed with from about 1 to 2% by weight fiber reinforcement prior to casting the bottom and top layers.

In another preferred embodiment, fiber reinforcement is added to the bottom and top layers by chopping and spraying continuous rolls of fiber reinforcement in a plurality of passes up and down the casting zone and the fibers are incorporated into the respective layers after each pass by rolling so as to substantially completely wet the fibers with the cementitious material. After rolling, the fibers can be needled into the cementitious material to provide increased strength.

A scrim reinforcing material can be positioned so as to reinforce the edges of the modules formed and this is preferably accomplished by imbedding scrim at least around the edges of the bottom layer with excess scrim extending up and over the side rails, the excess being folded in and imbedded in the top layer.

A cement deflecting screed is preferably employed to level the bottom layer by movement of the screed along the longitudinal length of the casting zone and to also fill the free space surrounding each core and leveling the top layer. The screed can be vibrated as it moves along the casting zone.

Two or more foam cores can be used for each module in place of a single core member and are preferably spaced apart with the free space therebetween filled with cementitious material at the same time the free space surrounding each core is filled with cementitious material.

In an alternate embodiment, at least one of the core members is provided with one or more reinforcing slots or grooves which are filled with wet cementitious material in the course of forming the modules.

Apparatus of the invention for making a plurality of modules includes the following:

(a) casting bed means including longitudinal side rail means along a base;

(b) division members inserted transversely between the side rail means and positioned so as to correspond to the lengths of the modules being formed;

(c) means for applying wet cementitious material over the base and division members along the length of the casting bed means and for leveling same so as to be even with the top of the division members to continuously cast a bottom layer of wet cementitious material;

(d) means for applying discrete lengths of fiber reinforcement to the casting zone onto the bottom layer and for incorporating the fibers into the bottom layer.

(e) end members adapted to be inserted between the side rail means on top of the division members to divide the casting bed into lengths corresponding to the lengths of the modules being formed;

(f) means for positioning foam core members on each of the bottom layer lengths between the end members, said foam core members having a peripheral shape smaller than the surface of the bottom lengths so as to leave a free space between the core member, the longitudinal side rail means and the end members and a height less than the height of the longitudinal side rail means;

(g) said means for applying wet cementitious material being adapted to apply wet cementitious material to the length of the casting bed means so as to fill the free space surrounding each core member and to form a top layer which covers each core member;

(h) said means for applying fiber reinforcement being adapted to apply discrete lengths of fiber reinforcement onto the top layer and to incorporate the fibers into the top layer; and (i) means for removing a plurality of cured modules from the casting bed.

DESCRIPTION OF THE DRAWINGS

The present invention will be more fully understood from the following description taken in conjunction with the accompanying drawings, wherein

FIG. 8 is a top view of the retaining members on the casting bed;

FIG. 9 is a perspective view showing a step in the process of the present invention;

FIG. 10 is a perspective view showing a succeeding step in the process;

FIG. 11 is a perspective view showing a further step in the process;

DETAILED DESCRIPTION OF THE PREFERRED EMBODIMENTS

Figure 1A:
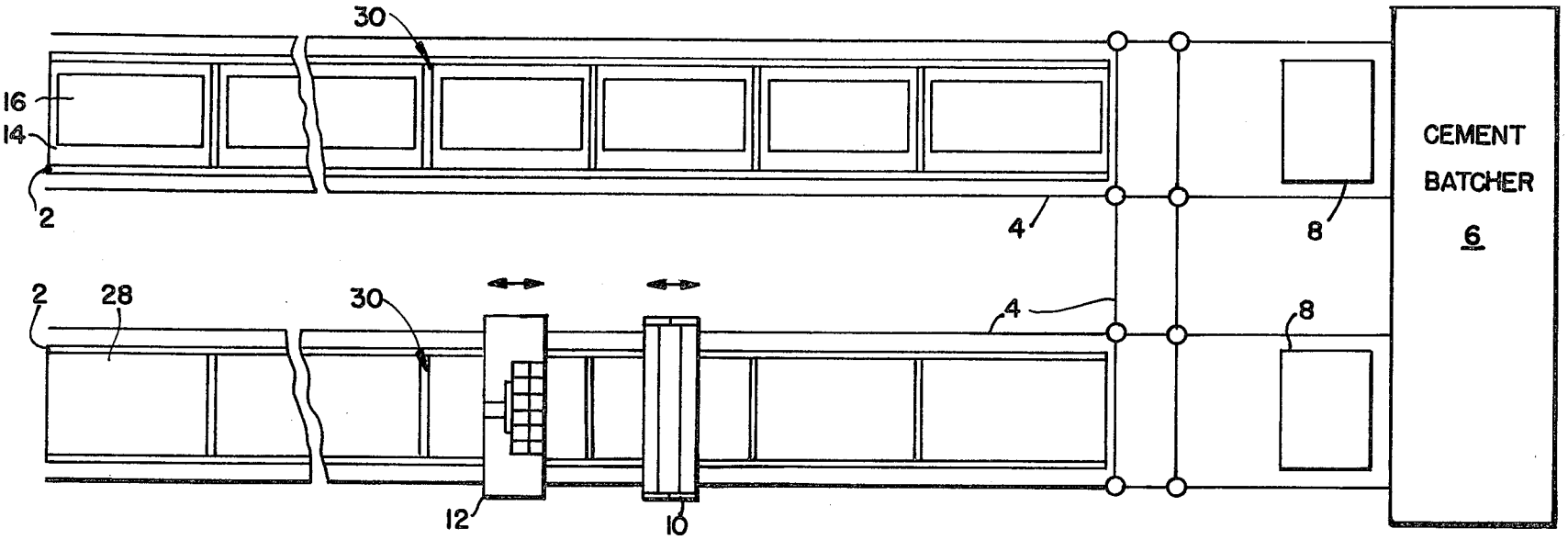
FIG. 1A is a top view of the apparatus of the present invention.
Figure 1B:
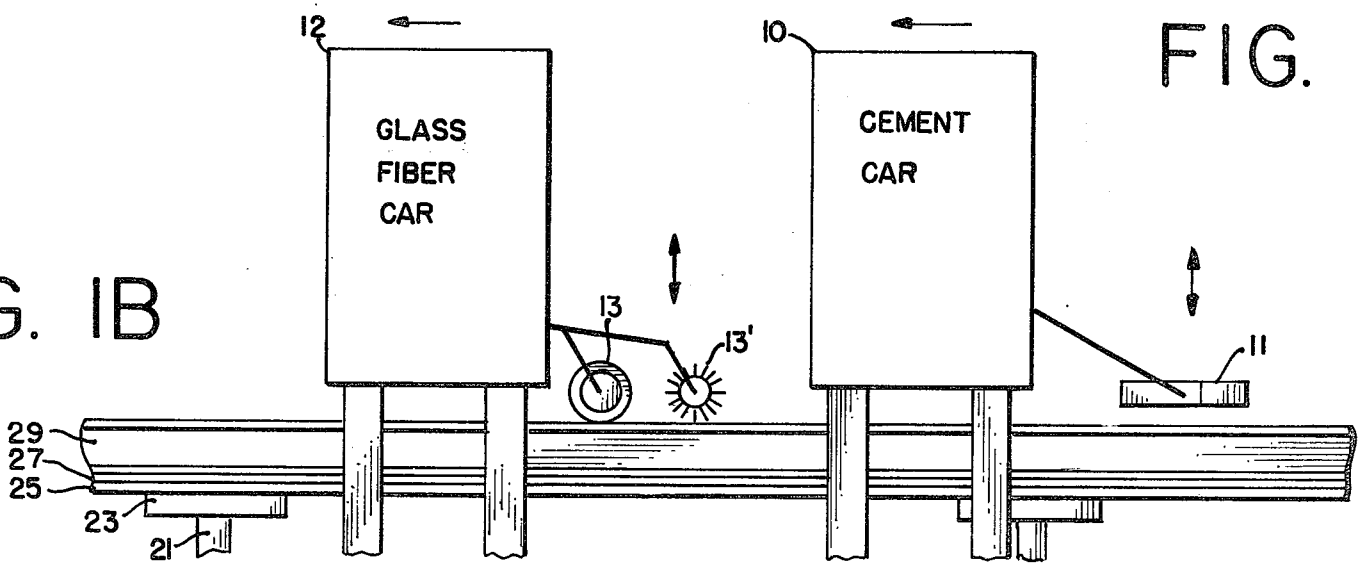
FIG. 1B is a side view of the apparatus of FIG. 1A.

Referring now to FIGS. 1A and 1B, the system includes a cement batcher 6 which receives the various components of the cementitious material for mixing same. A cement car 10 travels on the horizontal and vertical tracks 4 for positioning under the cement batcher 6 and for thereafter depositing the cementitious material onto the casting beds 2.

Also provided in glass fiber car 12 which travels on tracks 4 for depositing chopped or cut fibers into the wet cementitious material to obtain a fiber reinforced cementitious material.

Bins 8 are also provided for catching waste material from the cement car.

The cement batcher 6, as shown in FIG. 1A, stores and automatically dispenses measured amounts of raw materials into a mixer. The raw materials are supplied through inputs (not shown) into compartments therein and the desired amounts of the various materials are delivered into a hopper where it is then supplied to a mixer and dispensed into cement car 10.

The cementitious material is preferably common cement in admixture with conventional fillers such as sand or pumice and can contain conventional additives such as lime and sterates for water resistance, latex for added strength and wetting ability with respect to the fiber reinforcement, and water reducing agents such as Pozzolith for quick setting. Conventional tints or dyes can also be used to provide the desired coloration. It is also possible to use as a cementitious material, a sulfur-based product marketed under the trademark "Sument" by Chevron Chemical Company. This sulfur-based material can be used in admixture with sand or other conventional fillers following known techniques for handling this type of material.

The track system 4 shown in FIG. 1A includes both longitudinal and transverse tracks and may preferably be comprised of V-shaped rails of iron or steel. The transverse tracks can be used to shuttle the cement and glass cars for use on either of the parallel casting beds 2.

Cement car 10 receives a cement mixture from the cement batcher 6 and preferably includes a hopper for directing the cementitious material onto the casting bed 2. In order to effect an even distribution of the cementitious material, a screed 11 is used.

Figure 2:
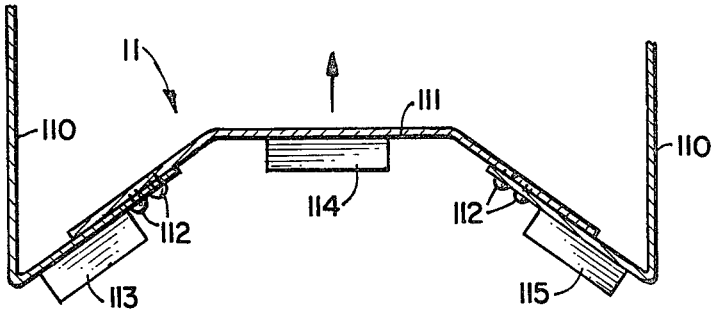
FIG. 2 is a top view of the screed.
Figure 3:
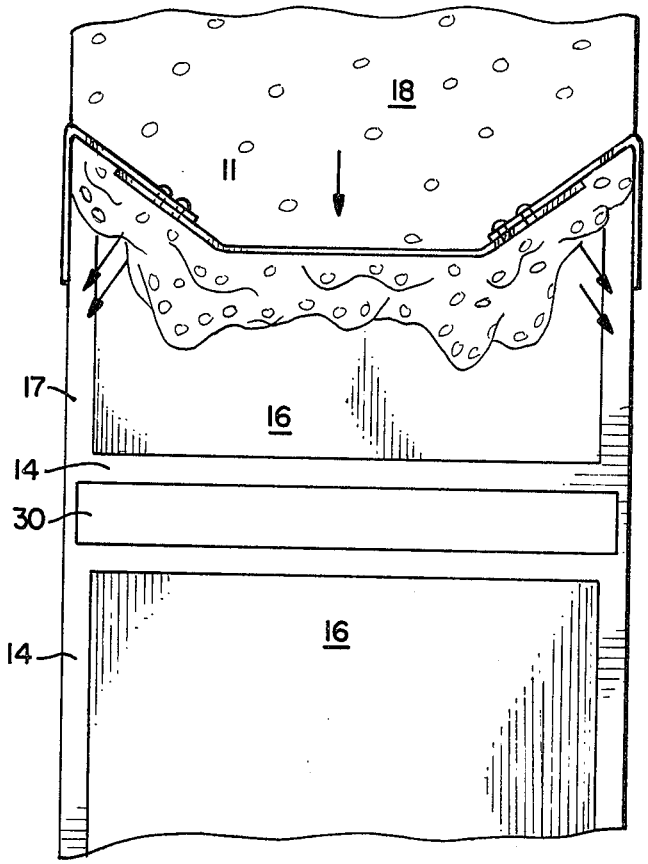
FIG. 3 is a top view of the screed in use on the casting bed.
Figure 7:
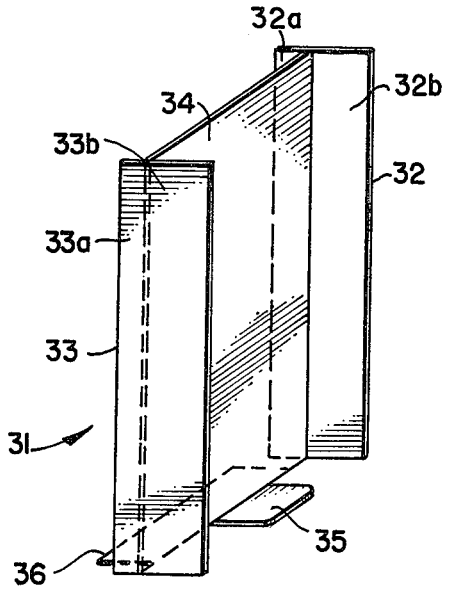
FIG. 7 is a perspective view of a retaining member.

The screed 11 is mounted downstream of the cement car 10 and preferably has two V-shaped end portions 110 and a central portion 111 which is perpendicular to the direction of travel (FIGS. 2 and 3). The V-shaped end portions 110 are adjustably connected to the central portion 111 via a screw and slot arrangement including bolts 112. By adjusting the width of the screed 11, it can be used on any desired width casting bed to assure the proper filling, distribution and leveling of cementitious material in the course of the process.

In order to obtain an even distribution of the cementitious material for each layer, vibrators 113–115 are provided thereon and which can be supplied with power from the cement car. FIG. 3 shows how the cement is directed by the screed to the sides of the foam core 16 to fill free space 17 and to form the top layer 18 to fully encase the foam core 16 in conjunction with the bottom layer 14.

The glass fiber car 12 includes spray nozzles for insuring uniform controlled spray of glass fiber onto the cementitious material and also includes a glass fiber cutter for cutting the supply of glass fiber into roll lengths of desired length. The car is further disclosed in co-pending application Ser. No. 810,451 filed June 27, 1977, now U.S. Pat. No. 4,123,212 issued Oct. 31, 1978.

The fiber car includes a roller 13 followed by a needler 13' disposed downstream thereof for effecting wetting of the fiber by the cementitious material and good distribution of the fibers below the surface of the layer of cementitious material. It has been found that the modulus of rupture of a hardened layer of fiber reinforced cementitious material is increased almost threefold as a result of needling the fibers into the cementitious material rather than merely spraying them down and rolling and/or vibrating to incorporate the fibers into the cementitious material.

The roller 13 can be solid or it can have a series of transverse and/or circular ridges or ribs to promote wetting of the fiber for incorporating same into the cementitious material without disturbing the random matrix that results from chopping and spraying the fibers or by otherwise depositing precut fibers for example by hand throwing.

The needler 13' can have a plurality of blunt or sharp needles, pins or rods radiating from the longitudinal axis thereof to in effect push the fibers down into the cementitious material, again without breaking the fiber matrix.

Figure 4:
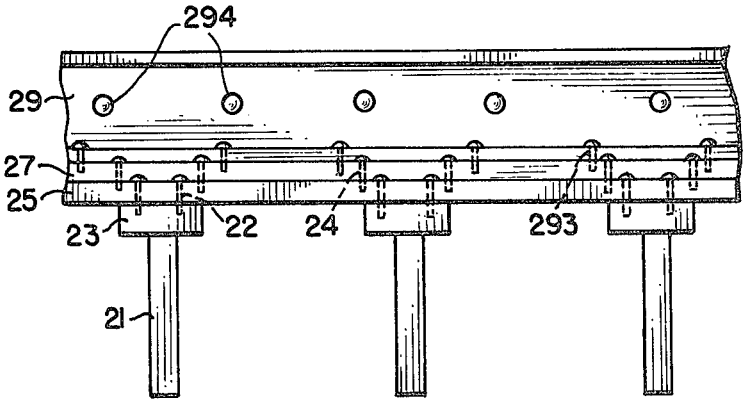
FIG. 4 is a detailed cross-sectional view of the casting bed.
Figure 6:
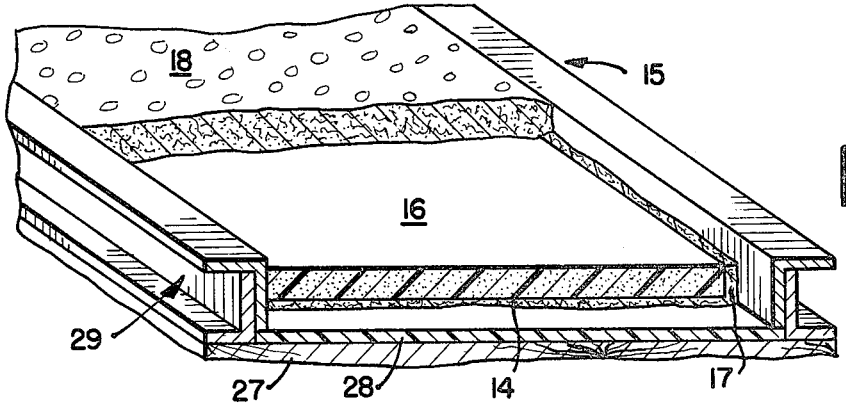
FIG. 6 is a perspective view of the front of the casting bed.
Figure 5:
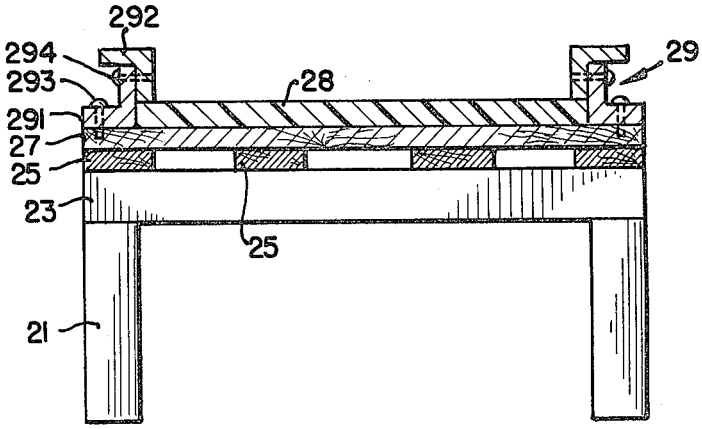
FIG. 5 is a front cross-sectional view of the casting bed.

The casting bed 2 is shown in detail in FIGS. 1A, 1B and 4–6 and will be discussed with reference thereto. The casting bed 2 includes legs 21 connected to a plurality of cross bars 23 which run along the width of the casting bed. Disposed on the cross bars 23 and running the length of the casting bed are furring strips 25, preferably composed of wood or other hard material. Disposed on the furring strips 25 is a planar base member 27 which is also preferably composed of wood. Side rails 29 comprising a fixedly mounted first member 291 and a vertically adjustable L-shaped member 292. L-shaped members 291 and 292 are connected to one another via bolts 294, which, with slots in member 292 enable the vertical adjustability to receive a liner 28 thereunder which sits on the planar member 27 and which is preferably made of plastic or silimar material. The liner is held in place by the side rails as shown in FIG. 5.

The side rail members 291 are preferably held in place on the casting bed by bolts 293 which extend into the base 27. The furring strips 25 and the base member 27 are preferably held in place by nails or flathead screws 22 and 24, respectively as shown in FIG. 4.

In use, the side rail member 292 with liner 28 form the boundries of a mold which in conjunction with end members disclosed hereinafter, define the sizes of the modules being formed. The bottom layer of fiber reinforced cementitious material is formed directly on liner 28 and then a rigid foam core 16 is disposed thereon and thereafter is encased in wet cementitious material including side layers 17 and a top layer 18.

In accordance with the above description of the apparatus, the process for making a plurality of building modules having an insulating foam core 16 encased in a shell 15 of cementitious material includes a casting zone which is defined between the side rails 29 for the width and by the positioning of spacers between the side rails 29 for the length. Referring to FIGS. 1A, 3 and 7–11, the apparatus and the process for using the spacers will be discussed with respect to the forming of a plurality of modules.

In order to maintain the spacers 30 in place, retaining members 31 are utilized at the desired locations of the spacers. The retaining members 31 (FIG. 7) include side walls 32 and 33 which are parallel to the spacer members during use and an end wall 34 which extends between the two side walls 32 and 33. Portions 32*b* and 33*b* in conjunction with member 34 define a channel for receiving the spacer member. Portions 32*a* and 33*a* project from member 34 and abut against the side rail during use. A first tongue 36 is also provided which extends outwardly from the ends of portions 32*a* and 33*a* and enables the retaining member 31 to be locked in position by the side rails. As shown in FIG. 8, a portion of the tongues 36 are disposed below the side rail member 292 between same and the liner 28. This effectively holds the retaining members in position during the process. The tongue 35 is also utilized for supporting the spacer member when disposed in the channel and to keep the retaining member from fulcruming during use. Spacer 30 is made up of division strip 37 and end member 38.

After the retaining members 31 are set in place as shown in FIG. 8, a division strip 37 is disposed in the channels formed thereby. The height of the division member 37 corresponds to the height of the bottom layer 18 that is to be formed and the bottom layer is continuously cast between the side rails and over the liner 28 and the division strips 37 along the length of the casting zone. The bottom layer is leveled to be even with the top of the spacer member 37 as shown in FIG. 10.

Thereafter, fiber reinforcement is added to the bottom layer 18 by applying fibers in discrete lengths in one or preferably a plurality of passes over the casting zone and the fibers are incorporated into the layer 18, preferably using glass car 12 as described herein, or by other means such as by hand throwing precut fibers. It is preferred that the layer 18 contain from 1 to 2 percent by weight fiber reinforcement. This can be done in the batcher 6 by adding precut fibers ranging in length from ¼ to 2 inches, preferably about ½ inch, to the wet cementitious mixture and mixing for about 5 minutes before casting. The use of 1 to 2 percent fiber and a short mixing time allows for even distribution and prevents breaking the matrix which is evidenced by cat balling of the fibers.

End members 38 are placed over the division members 37 in the channel formed between the retaining members 31. The foam cores 16 are also placed on the bottom layers 14 while the bottom layers 14 are still wet and the top of the end member 38, as shown in FIG. 11, is higher than the top of the foam core when placed on the bottom layer 14 so that after successive application of wet cementitious material and chopped fiber, a uniform layer of wet cementitious material encases the core member 16 and includes the top layer 18 with the height shown in FIG. 11.

It should be noted that the foam core 16 has a peripheral shape that is smaller than that of the bottom layer 14 so as to leave a free space between the core 16 and the side rails 29 and between the cores 16 and the spacers 30. This, in conjunction with the fact that the core has a height less than the side rails 29 and the overall spacer 30, enables the side layers and the top layer to be cast to completely and separately encase each core 16 in a wet, fiber reinforced, cementitious shell.

Spacer members can also be used between the core and the spacer 30 and the core and the side rails 29 so that a uniform distance therebetween is maintained during the process to insure uniform shell thickness.

The fiber reinforced, cementitious material encasing each core has a matrix of randomly interconnected fiber reinforcement which is put in tension as the cements cures and shrinks. Cured modules are withdrawn from the casting zone by hand or mechanically.

In alternative embodiments, a scrim reinforcing material may be employed as disclosed in co-pending application Ser. No. 848,411 filed Nov. 3, 1977, now U.S. Pat. No. 4,229,497. Preferably, scrim is imbedded at least around the edges of the bottom layer 14 with excess scrim extending up and over the side rails 29. The excess is folded in before, during or after the sides 17 are filled and imbedded in the top layer 18, again before, during or after formation of top layer 18.

The bottom layers 14, with fiber reinforcement applied if desired, can be cured to obtain a glass reinforced concrete (GRC) panel. GRC panels have applications for many products such as cladding panels, permanent form work, tunnel linings, street and garden furniture, air ducts, refuse chutes, pipes, small buildings and storage vessels. It can be made from grey, white or brown Portland cement and other specialty cements and can have profiled, high relief or textured surfaces. The same and other cements can be used to form the composite modules.

The fibrous reinforcement in fiber form is preferably glass fiber chopped from rovings in lengths of one-quarter to three inches and preferably from one to two inches. A preferred glass fiber is AR (alkali resistant) glass fiber sold under the trademark CEM-FIL and more particularly described in U.S. Pat. No. 3,901,720.

For GRC, the generally recognized glass content is 5±0.5% by weight with the glass fibers being distributed in an interconnected random matrix. The interconnection results from a physical, mechanical or cohesive interlock between glass fibers which is enhanced when the cementitious material cures around the foam core and shrinks, putting the fibers in tension.

According to a preferred embodiment, by using a combination of 1 to 2% premixed fibers and from 1 to 3% chopped and sprayed fibers, it has been found that less than the generally recommended amount of glass fibers can be employed without any loss of strength. When the chopped fibers are needled as described herein, strengths can exceed those obtained with 5% glass. For example a GRC panel containing 1½% of one-half inch premixed fibers and 2% of two inch chopped, sprayed and needled glass fibers (for a total of only 3½% by wt. fiber reinforcement) exhibits strengths exceeding those obtained with 5% by wt. chopped and sprayed fibers (not needled and without shorter premixed fibers).

Other similar and equivalent fibrous materials can be used for the fibrous reinforcing materials within the context of the present invention. For example, the fiber can be made of conventional E glass fiber, (including E glass fiber-coated to impart alkali resistance to the glass for example with a polyester coating), AR glass such as described above, aramid fibers, nylon fibers, polyester fibers and the like including natural and synthetic inorganic and organic fibers, for example, graphite fibers.

The scrim material that can be used can be an aramid fiber (e.g., Kavlar-DuPont) which reinforces the interaction of the cement shell on the foam core. The scrim reinforcement can be just below the surface of the shell so that it is thoroughly imbedded in the cement and glass fiber to insure maximum reinforcement. In other words, the glass fiber and the scrim reinforcement should be thoroughly wetted by the cementitious material.

The term scrim is used herein to include woven, nonwoven and dense chopped fiber layers which functions as a reinforcing layer with respect to composite modules made by the invention. The scrim material can be coarse or fine so long as it is sufficiently open to allow the cementitious mixture to penetrate and wet the scrim layer itself. Generally, the scrim reinforcing material will have a screen-like appearance with openings as small as an eighth of an inch up to two inches or more, preferably with openings of about a quarter of an inch up to one inch. Naturally, the type and configuration of the scrim reinforcing material will depend upon the ultimate use for the module being produced. For panels measuring approximately five by ten feet and four inches thick, a single layer of polymer coated, E glass scrim with openings of approximately one-half inch either surrounding the foam core or adjacent to the major surfaces, that is the front and back of the panel, has been found to provide adequate reinforcement for these particular applications.

Because of availability and cost, the preferred fibrous reinforcement is glass fiber and preferably AR glass fiber and the scrim reinforcing material is preferably E glass coated to impart alkali resistance. However, other similar and equivalent fibrous materials can be used for the fibrous reinforcing materials within the context of the present invention. For example the fiber and/or scrim reinforcing materials can be the same or different. Mechanical treatments such as rolling are employed to incorporate the glass fiber matrix and/or scrim reinforcing material into the wet cement mixture. The use of dilute latex can also assist in the wetting operation.

Suitable rigid foams include inorganic and organic foams. Rigid urethane polymer foams are preferred and these well-known materials are widely used principally for insulation purposes. Urethane polymer foams are commonly formed by combining the reactants (a polyol and an isocyanate) using airless spraying or liquid application techniques. Foaming commences almost instantaneously and is completed within a very short time depending on the type of urethane polymer composition employed. The density of rigid urethane foams also depends on the nature of the urethane composition employed but generally ranges between about 1.5 pounds per cubic foot to ten pounds per cubic foot, more commonly from 2 to 5 pounds per cubic foot. Other suitable rigid foams include polyester foams, phenolic resin foams, isocyanurate foams and sulfur-based foams marketed under the trademark SUFOAM by Chevron Chemical Company.

After fabrication of the module is complete, the cement is allowed to cure under ambient conditions or in a steam heated enclosure. Curing can also be accelerated using hot wet cement made with water at about 122° to 200° F. Once the cement is cured the composite module is removed from the casting zone mechanically using slings or lifting inserts molded into the module shell or by hand.

Typical properties of commercially available rigid urethane polymer foams are set forth in the following table:

TYPICAL RIGID URETHANE FOAM PROPERTIES

| Density lb./cu.ft. Astm D 1622 | Compressive Strength psi Astm D 1621 | Compressive Modules psi Astm D 1621 | Shear Strength psi | Shear Modules psi |
|---|---|---|---|---|
| 1.5–2.0 | 20–60 | 400–2000 | 20–50 | 250–550 |
| 2.1–30 | 35–95 | 800–3500 | 30–70 | 350–800 |
| 3.1–45 | 50–185 | 1500–6000 | 45–125 | 500–1300 |
| 4.6–70 | 100–350 | 3800–12,000 | 75–180 | 850–2000 |

Additional embodiments of the building module can be obtained utilizing the process and apparatus of the present invention. For example, in FIG. 12, each individual module can be formed with more than one foam core therein. As shown, the glass reinforced concrete shell 15 encases four cores 161–164. The cores may be placed adjacent each other and held together by mechanical means such as a metal band, however, preferably, the cores are spaced apart so that a fiber reinforced concrete rib 165 is disposed therebetween which imparts sufficient strength to the overall module to enable modules of 20 feet in length to be produced without the use of scrim around the edges of the module.

Figure 13:
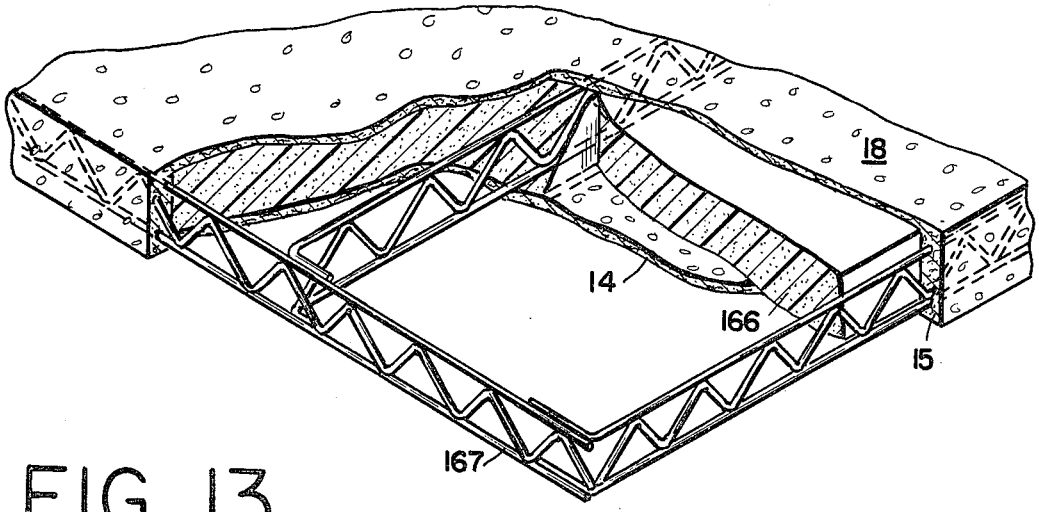
FIG. 13 is a further embodiment of a building module.

As shown in FIG. 13, the modules can be further reinforced by use of a metallic reinforcing strip 167 which surrounds one or more cores 166. These reinforcing strips, depicted as shown, are sold under the trademark name of "DUROWALL" and are traditionally used to reinforce monolithic concrete members.

Figure 12:
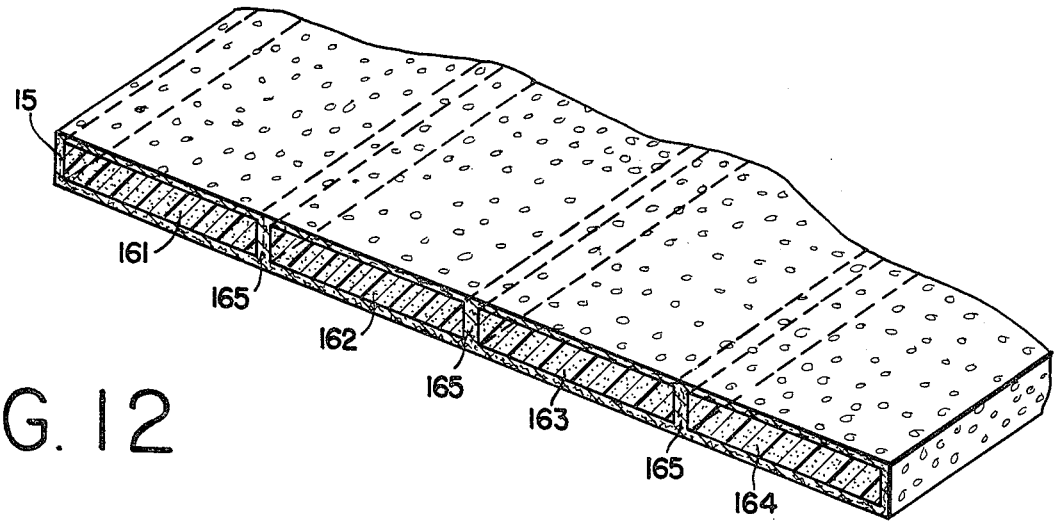
FIG. 12 is a perspective view of an alternative embodiment of the building module.
Figure 14:
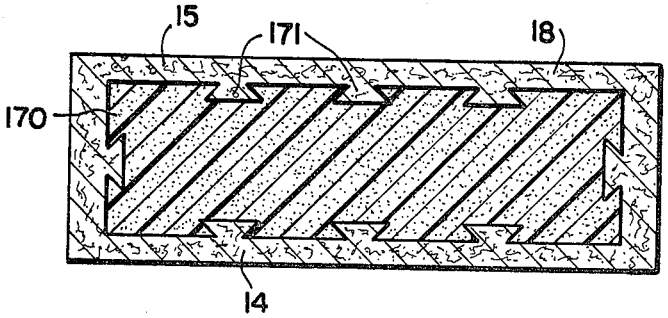
FIG. 14 is a side view of another embodiment of a building module.

In order to obtain even further reinforcing, the core 170 has reinforcing ribs such as the dovetail grooves 171 shown in FIG. 14. During the process for making a building module utilizing a core of this type, glass reinforced cement or cement alone fills the bottom in the dovetail grooves 171 prior to placing of the foam core on the bottom layer. The remaining grooves in the sides and top can be pre-filled or can be filled in the course of filling the sides and forming the top layer. The grooves can have other shapes in cross-section such as square. The wet cement in the grooves joins the wet cementitious material 15 encasing the core 170 and the ribs formed in the dovetail grooves provide additional strength. One or more of the foam cores as shown in FIG. 14 can be used as shown in FIG. 12.

What is claimed is:

1. Process for making a plurality of building modules each having at least one insulating foam core encased in a shell of fiber reinforced cementitious material which comprises:

(a) providing a continuous longitudinal casting zone having continuous side rails along a base having transverse division members thereon positioned so as to correspond to the lengths of the modules being formed;

(b) continuously casting a bottom layer of wet cementitious material between the side rails and over the base and division members along the length of the casting zone and leveling said bottom layer so as to be even with the top of the division members;

(c) adding fiber reinforcement to the bottom layer formed in step (b) by applying fibers in discrete lengths in one or more passes over the casting zone and incorporating the fibers into the bottom layer;

(d) dividing said casting zone into lengths corresponding to the lengths of the modules being formed by inserting end members on top of the division members between the side rails;

(e) placing foam core members on each length of the bottom layer between end members, said foam core members having a peripheral shape smaller than the surface of the bottom lengths so as to leave a free space between the core member, the side rails and the end members, said core member having a height less than the height of the said side rails;

(f) applying wet cementitious material to the entire length of the casting zone so as to fill the free space surrounding each core member and to form a top layer which covers each core member thereby separately encasing each core member;

(g) applying fiber reinforcement to the top layer formed in step (f) by applying fibers in discrete lengths in one or more passes over the casting zone and incorporating the fibers into the top layer; and (h) curing the cementitious material encasing each core and removing a plurality of cured modules from the casting zone.

2. Process of claim 1 which includes the step of premixing the wet cementitious material with from about one to two percent by weight fiber reinforcement prior to steps (b) and (f).

3. Process of claim 1 wherein fiber reinforcement is added to the bottom and top layers by chopping and spraying continuous rolls of fiber reinforcement in a plurality of passes over the casting zone and the fibers are incorporated into the layers after each pass by rolling so as to substantially completely wet the fibers with the cementitious material.

4. Process of claim 1 wherein a scrim reinforcing material is positioned at least around the edges of the core members.

5. Process of claim 4 wherein scrim is imbedded at least around the edges of the bottom layer with excess scrim extending up and over the side rails, said excess being folded in and imbedded in the top layer.

6. Process of claim 1 further comprising providing a cement deflecting screed movable along the longitudinal length of the casting zone and wherein step (b) includes leveling the bottom layer by movement of the screed and step (f) includes filling the free spaces surrounding each core member and leveling the top layer by the movement of the screed.

7. Process of claim 6 wherein the screed is vibrated as it moves along the casting zone.

8. Process of claim 1 further comprising after step (e), inserting spacing members between the foam core and both the side rails and the end members to insure uniform shell thickness.

9. Process of claim 1 further comprising providing retainers along the side rails to maintain the division members and the end members in position.

10. Process of claim 1 wherein steps (c) and (g) include needling the fibers into the cementitious material.

11. Process of claim 3 wherein the fibers are needled into the cementitious material after rolling.

12. Process of claim 1 wherein at least two foam core members are placed between each pair of end members.

13. Process of claim 12 wherein the cores are spaced apart and the free space therebetween is filled with cementitious material in step (f).

14. Process of claim 13 wherein the cores have a reinforcing member between them.

15. Process of claim 1 wherein at least one core has reinforcing slots therein and the process further comprises filling the slots with wet cementitious material.

16. Process for making a plurality of fiber reinforced discrete unconnected cementitious building modules which comprises:

(a) providing a continuous longitudinal casting zone having continuous side rails along a base having transverse division members thereon positioned so as to correspond to the lengths of the modules being formed;

(b) continuously casting a layer of wet cementitious material between the side rails and over the base and division members along the length of the casting zone and leveling said bottom layer so as to be even with the top of the division members such that adjoining modules are unconnected and discrete;

(c) adding fiber reinforcement to the layer formed in step (b) by applying fibers in discrete lengths in one or more passes over the casting zone and incorporating the fibers into the bottom layer; and (d) curing the cementitious material and removing a plurality of cured modules from the casting zone.

17. Process of claim 16 which includes the step of premixing the wet cementitious material with from about one to two percent by weight fiber reinforcement prior to step (b).

18. Process of claim 16 wherein fiber reinforcement is added by chopping and spraying continuous rolls of fiber reinforcement in a plurality of passes over the casting zone and the fibers are incorporated into the layers after each pass by rolling so as to substantially completely wet the fibers with the cementitious material.

19. Process of claim 16 wherein the fibers are needled into the cementitious material after rolling.

* * * * *